US007126049B2

(12) United States Patent
Tanaka

(10) Patent No.: US 7,126,049 B2
(45) Date of Patent: Oct. 24, 2006

(54) METHOD OF IMPROVING REPETITIVE STRIKING PERFORMANCE, JACK AND ACTION MECHANISM OF PIANO

(75) Inventor: Kousuke Tanaka, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 174 days.

(21) Appl. No.: 10/900,550

(22) Filed: Jul. 28, 2004

(65) Prior Publication Data

US 2005/0028665 A1 Feb. 10, 2005

(30) Foreign Application Priority Data

Aug. 4, 2003 (JP) ..... 2003-286045

(51) Int. Cl.
*G10C 3/00* (2006.01)

(52) U.S. Cl. ..... 84/236; 84/243; 84/174; 84/216; 84/253

(58) Field of Classification Search ..... 84/236, 84/241–243, 247–249, 174, 216, 253, 237–240, 84/176

See application file for complete search history.

(56) References Cited

U.S. PATENT DOCUMENTS 2,495,427 A * 1/1950 Shill ..... 84/238
2,844,984 A * 7/1958 Dasenbrook et al. ..... 84/240
4,995,291 A * 2/1991 Takahashi ..... 84/237
5,511,454 A * 4/1996 Jones et al. ..... 84/236
5,911,167 A * 6/1999 Jones et al. ..... 84/236
6,232,537 B1 * 5/2001 Kimble ..... 84/216

FOREIGN PATENT DOCUMENTS

JP 49-919 4/1947
JP 9-281959 10/1997

* cited by examiner

*Primary Examiner*—Gary F. Paumen
(74) *Attorney, Agent, or Firm*—Davis & Bujold, P.L.L.C.

(57) ABSTRACT

A jack used in an action mechanism of a piano has substantially an L-shape, composed of a big jack portion and a small jack portion. The thickness of the small jack portion is made smaller than that of the big jack portion in a direction of key arrangement in a state of the jack being fitted in the piano. By reducing the weight of the small jack portion as above, the time required for the jack to return to a position capable of pushing up a part of a striking member can be shortened. Accordingly, more frequent repetitive striking is allowed within a predetermined period.

3 Claims, 4 Drawing Sheets

RELATION BETWEEN JACK WEIGHT AND REPETITIVE STRIKING PERFORMANCE

METHOD OF IMPROVING REPETITIVE STRIKING PERFORMANCE, JACK AND ACTION MECHANISM OF PIANO

This application claims priority from Japanese application serial no. 2003-286045 filed Aug. 4, 2003.

BACKGROUND OF THE INVENTION i) Technical Field of the Invention

This invention relates to a technique of improving repeated striking performance of a piano.

ii) Description of the Related Art

A piano is conventionally provided with a known action mechanism that operates in response to key depression and makes a striking member strike a string, as disclosed in Unexamined Japanese Patent Publication No. 9-281959, for example.

Also, as can be seen in Unexamined Japanese Utility Publication No. 49-919, the action mechanism comprises a substantially L-shaped jack composed of elongated portions, specifically, a big jack portion and a small jack portion. The small jack portion is arranged almost perpendicular to the big jack portion. The thickness of the big jack portion and the small jack portion is nearly constant in the direction of key arrangement in a state of the jack being fitted in the piano.

In the action mechanism as above, the jack is raised in response to key depression and pushes up a shank roller, that is, a part of the striking member, with the apex of the big jack portion. Furthermore, when the free end of the small jack portion abuts on a regulating button, the jack is rotated and the apex of the big jack portion is separated from the shank roller. Then, the striking member, which was pushed up by the jack, swings to a string side to strike a string.

SUMMARY OF THE INVENTION

In this type of action mechanism of a piano, when a player stops depressing a key and therefore releases the key, the jack, in a state of having pushed up the shank roller, is returned in a reset direction (that is, a direction toward the original position where the jack had been located prior to the key depression) by the spring force of a repetition spring. As the jack is returned to a position (hereinafter, referred to as a push-up capable position) capable of again pushing up the striking member which has struck a string and returned, the jack is ready for the next striking of the string (a repeated striking). Accordingly, if the time required for the jack to return to the push-up capable position is made shorter, greater number of times of repeated striking can be exercised within a predetermined period.

However, the spring force of the repetition spring has limits to shortening the aforementioned time. Consequently, the conventional action mechanism is also limited in improving repetitive striking performance. This results in a failure to fully comply with the demands for high-speed repetitive striking from players having advanced playing skills. Here, the action mechanism of a grand piano is taken as an example. However, the same problem exists in the action mechanism of an upright piano.

One object of the present invention, which was made to solve the above problem, is to improve the repeated striking performance of a piano.

In order to attain the above object, one aspect of the present invention provides a method of improving the repeated striking performance of a piano comprising an action mechanism in which a substantially L-shaped jack pushes up a part of a striking member in response to a key depression in order to make the striking member strike a string.

The jack is composed of elongated jack portions, that is, a big jack portion that pushes up the striking member and a small jack portion arranged almost perpendicular to the big jack portion. Specifically, the weight of the small jack portion is reduced as compared to conventional designs, resulting in a lightened small jack portion.

According to such a method of improving the repeated striking performance, the rotational speed of the jack, when a spring force toward a reset direction is applied to the jack, is increased due to the reduction in weight of the small jack portion. As a result, the time required for the jack to return from a position where the jack has pushed up a part of the striking member (that is, a position immediately after striking a string) to a position capable of pushing up the part again (a push-up capable position) can be shortened.

Furthermore, in this case, only the weight of the small jack portion, rather than the weight of the jack as a whole, is trimmed. Therefore, sufficient strength for moving the striking member is maintained while achieving an improvement in the repeated striking property.

Another aspect of the present invention provides a jack to be used in an action mechanism of a piano. The jack is formed into substantially an L-shape and pushes up a part of a striking member in response to a key depression in order to make the striking member strike a string.

The jack is composed of an elongated big jack portion that pushes up a part of the striking member and a lightened small jack portion arranged almost perpendicular to the big jack portion. Particularly, the thickness of the lightened small jack portion is made thinner than the thickness of the big jack portion in a direction of key arrangement in a state of the jack being fitted in the piano.

In the above jack, the weight of the lightened small jack portion is reduced by making the thickness of the lightened small jack portion less than the thickness of the big jack portion (lightening).

If such a jack is used in the action mechanism of a piano, the rotational speed of the jack, when a spring force toward a reset direction is applied to the jack, can be increased, as already mentioned above. Accordingly, shortening the time is possible for the jack to return from a position where the jack has pushed up the part of the striking member to the push-up capable position. Moreover, only the weight of the small jack portion is trimmed rather than the weight of the jack as a whole. Therefore, sufficient strength for moving the striking member is maintained while achieving an improvement in the repeated striking property.

Further, another aspect of the present invention provides an action mechanism of a piano comprising a substantially L-shaped jack that pushes up a part of a striking member in response to key depression to make the striking member strike a string. Specifically, the jack described as above is used.

As a result, while the jack maintains sufficient strength for moving the striking member, it is possible to improve the repeated striking property of the piano.

BRIEF DESCRIPTION OF THE DRAWINGS

The invention will now be described by way of example, with reference to the accompanying drawings in which.

DETAILED DESCRIPTION OF PREFERRED EMBODIMENT

Figure 1:
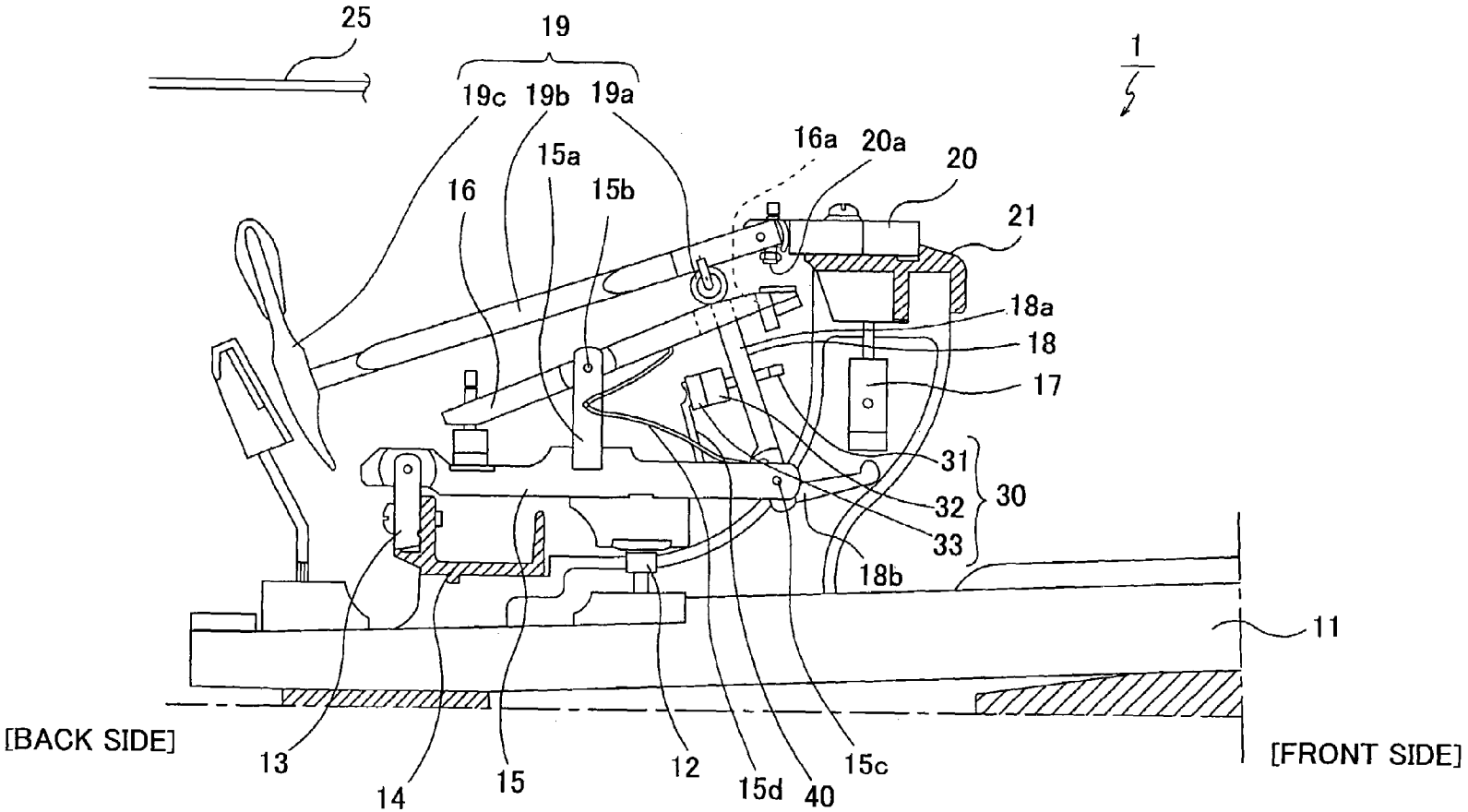
FIG. 1 is a view showing an action mechanism of a piano according to an embodiment of the present invention.

FIG. 1 shows an action mechanism 1 of a piano of the present embodiment. In the following description of the action mechanism 1, a player side (right side in FIG. 1) is referred to as a front side, and the side opposite to the player side (left side in FIG. 1) is referred to as a back side. Also, directions of up and down in the following description correspond to those in FIG. 1, if not mentioned explicitly.

This action mechanism 1 comprises a capstan screw 12 that is raised when a key 11 is depressed by the operation of a player, a wippen 15 that is rotatably supported by a wippen rail 14 via a wippen flange 13 and swings upward by the rising of the capstan screw 12, a repetition lever 16 that is rotationally supported by a rotational shaft 15*b* provided at a top end of a support 15*a* on the wippen 15 and raised together with the wippen 15, a jack 18 that is rotatably connected to a rotational shaft 15*c* provided at an end of the wippen 15 and raised together with the wippen 15 until abutting on a regulating button 17, and a striking member 19 that is pushed up by the rising of the jack 18 so as to strike a string, etc. The striking member 19 is composed of a shank roller 19*a* that is pushed up by an apex (in more detail, the apex of a later-explained big jack portion 18*a*) of the jack 18 which passes through a long hole 16*a* provided in a tip portion of the repetition lever 16, a hammer shank 19*b* that is rotatably supported by a shank rail 21 via a shank flange 20 and swings upward when the shank roller 19*a* is pushed up, and a hammer head 19*c* that is attached to an end of the hammer shank 19*b* and moves upward by the swinging of the hammer shank 19*b* so as to strike a string 25.

Furthermore, the wippen 15 is provided with a repetition spring 15*b* which provides a resetting force to the repetition lever 16 and the jack 18 for returning them to their original positions where they were located before key depression.

Figure 2C:
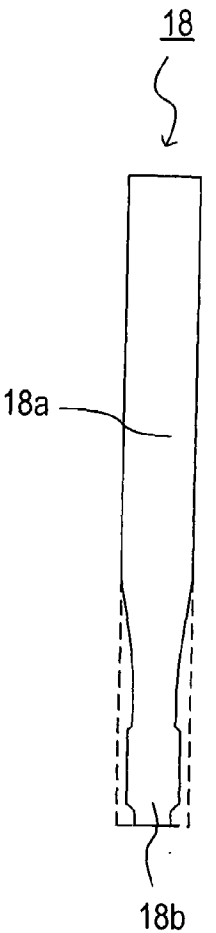
FIGS. 2A–2C are explanatory views illustrating a difference in shapes between a jack used in the action mechanism of the present embodiment and a conventional jack.
Figure 2B:
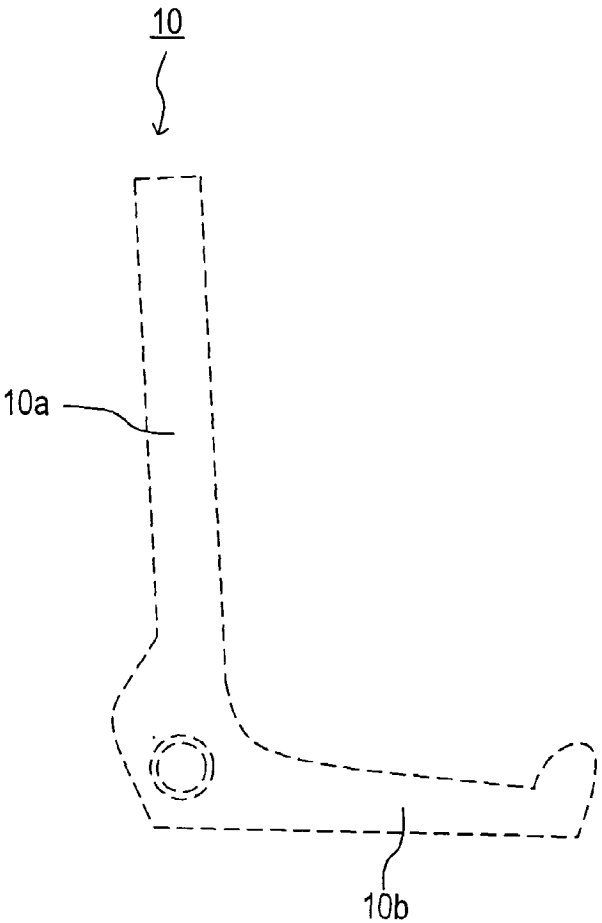
Figure 2A:
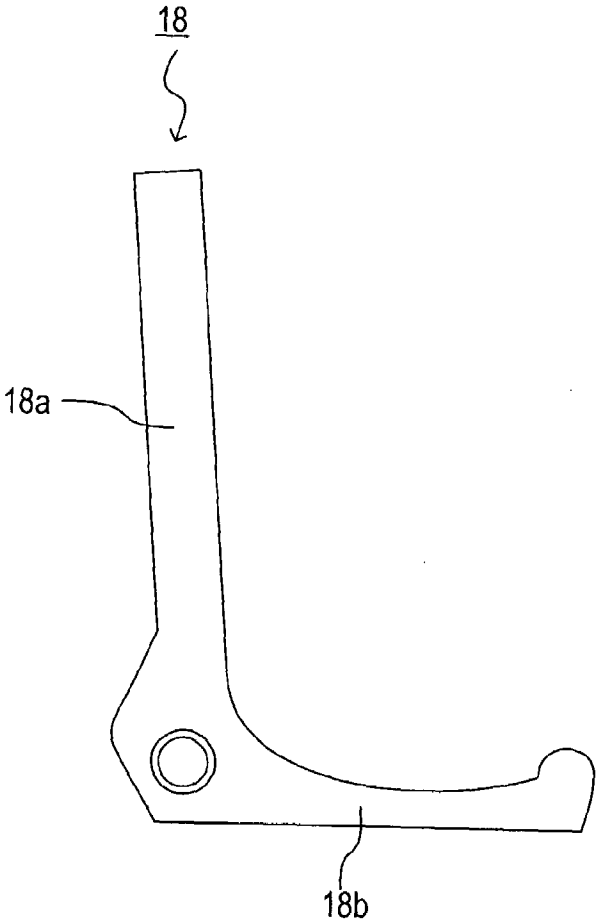

Now, the shape of the jack 18 is explained by referring to FIGS. 2A–2C. FIG. 2A is a view of the jack 18 in the present embodiment. FIG. 2B is a view of a conventionally used jack 10. FIG. 2C is a right side view of the jack 18. In FIG. 2C, the jack 10 is indicated by a dotted line.

The jack 10 is composed of an elongated big jack portion 10*a* and a small jack portion 10*b*. The big jack portion 10*a* is a portion extending in the vertical direction in FIG. 2B. The small jack portion 10*b* is a portion arranged almost perpendicular to the big jack portion 10*a*. Accordingly, the jack 10 is formed into a substantially L-shaped configuration.

The jack 18 is also shaped like an L-shape, comprising an elongated big jack portion 18*a* and a lightened small jack portion 18*b* arranged almost perpendicular to the big jack portion 18*a*. Specifically, the thickness of the lightened small jack portion 18*b* in a direction of key arrangement in a state of the jack 18 being fitted in the piano is thinner than the thickness of the big jack portion 18*a*.

As can be seen in FIG. 2C, there is no difference between the big jack portion 18*a* of the jack 18 and the big jack portion 10*a* of the jack 10. However, the thickness of the lightened small jack portion 18*b* is smaller than that of the small jack portion 10*b*. Accordingly, the overall weight of the jack 18 is less than that of the conventional jack 10. Specifically, the weight of the lightened small jack portion 18*a* is reduced. That is, the weight of the jack 18 is reduced by changing the shape of the lightened small jack portion 18*b*, without substantially changing the shape of the big jack portion 18*a*. Moreover, in the conventional jack 10, the upper side of the small jack portion 10*b* (that is, the side closer to the big jack portion 10*a*) has a linear shape. However, in the jack 18 of the present embodiment, the upper side of the lightened small jack portion 18*b* has a gently curved U-shape, resulting in a reduction of the width thereof (that is, the width in the vertical direction of the lightened small jack portion 18*b* in FIG. 2A). Thus, further decreasing the weight of the jack 18 is achieved (further lightening).

Returning to FIG. 1, when the jack 18 is fitted in the action mechanism 1, an adjustment member 30, which is a position adjustment mechanism of the jack 18, is attached to the big jack portion 18*a*. The adjustment member 30 is composed of a stop screw 31, a stop button 32, and a button felt 33. The button felt 33 abuts a top end portion of a spoon 40 provided on the wippen 15. By rotating the stop screw 31 the angle position of the jack 18 can be adjusted for a released key condition.

Now, the operation of the action mechanism 1 provided with the jack 18 is described.

When the player depresses a key 11 initially in a released state, the wippen 15 is pushed up to raise the repetition lever 16 and the jack 18. Along with the rising components, the repetition lever 16 slides under the shank roller 19*a* so as to push up the hammer shank 19*b* via the shank roller 19*a*. Subsequently, the repetition lever 16 abuts on the repetition screw 20*a* to stop the rise and swings. Then, the jack 18, initially moving upward together with the repetition lever 16, is raised further so as to push up the shank roller 19*a* with the apex of the big jack portion 18*a* (which passes through the long hole 16*a*). When the free end of the lightened small jack portion 18*b* abuts on the regulating button 17, the jack 18, which has stopped rising, is rotated clockwise in FIG. 1 to separate the apex of the big jack portion 18*a* from the shank roller 19*a*. Then, the striking member 19, pushed up by the jack 18, is in a free rotating state and rotates clockwise so as to make the hammer head 19*c* strike the string 25.

In the meantime, when the player stops depressing and releases the key 11 and the key 11 returns to a position of about one third (⅓) from a fully depressed depth, the jack 18, from a state of having pushed up the shank roller 19*a*, begins to return to the reset direction (that is, the original position where the jack 18 had been located before the key depression) together with the repetition lever 16 due to the spring force of the repetition spring 15*d*. When the apex of the big jack portion 18*a* is moved to a position below the shank roller 19*a*, the next striking of the string can be performed regardless of whether the key 11 is actually completely returned to the original position. Accordingly, it becomes possible to strike the same key 11 repeatedly like a trill.

Along with the movement of the key 11 to the original position, the wippen 15, the repetition lever 16, and the jack 18, are also moved in directions opposite to the directions they moved in at the time when the key 11 was depressed, so as to return to their original positions.

In the action mechanism 1 of the present embodiment as described above, the lightened small jack portion 18*b* of the jack 18 is made thin and the weight of the same is reduced compared to a conventional jack.

Therefore, the rotational speed of the jack 18 can be increased when the spring force toward the reset direction is applied to the jack 18. Furthermore, the time required can be shortened for the jack 18 to return from a position where the jack 18 has pushed up the shank roller 19*a* to the push-up capable position (the position below the shank roller 19*a*). Accordingly, more frequent repetitive striking becomes possible within a predetermined period, resulting in achieving an improvement in the repeated striking performance of the piano.

Moreover, only the weight of the lightened small jack portion 18*b*, rather than the weight of the jack 18 as a whole, is trimmed. Therefore, sufficient strength for moving the striking member 19 is maintained while the repeated striking property of the piano is improved.

Figure 3A:
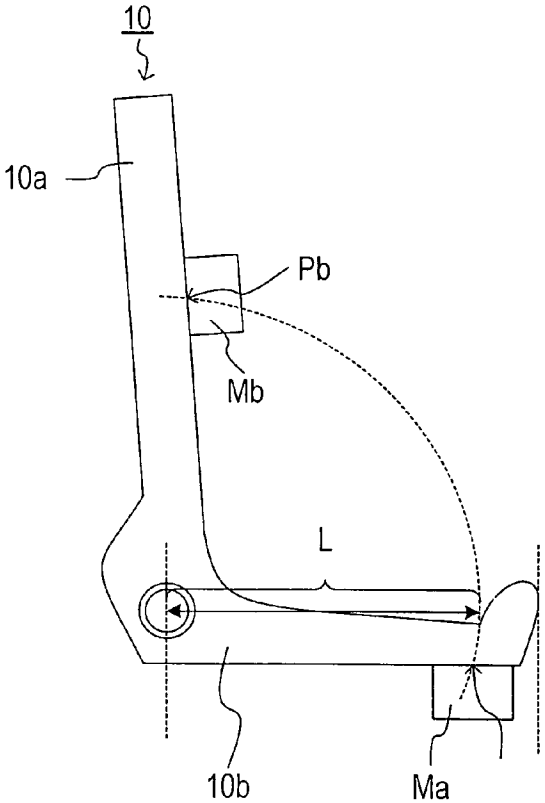
FIG. 3A is a view of a jack used in experiments for ascertaining the effects of the present embodiment and FIG. 3B is a graph showing the results of the experiments.
Figure 3B:
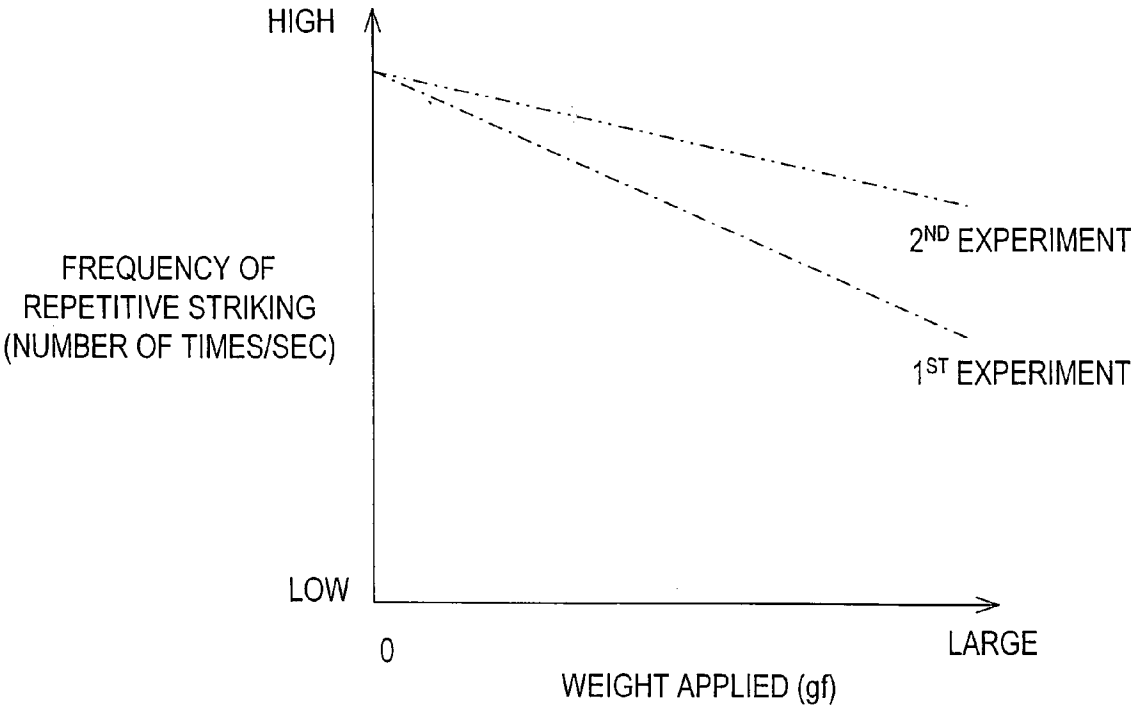

Experiments conducted to ascertain the above effects are now described referring to FIGS. 3A and 3B. FIG. 3A shows a jack used for the experiments which corresponds to the jack 10 shown in FIG. 2B. FIG. 3B is a graph showing the results of the experiments.

[First Experiment]

First of all, a distance L was made approximately seven eighth (⅞) of the distance between the rotational shaft of the jack 10 and the free end (end on the side opposite to the rotational shaft) of the small jack portion 10*b*. Also, as shown in FIG. 3A, a position Pa was made at a location on the small jack portion 10*b*, away from the rotational shaft by the distance L.

In a first experiment, the weight of a plummet Ma attached to position Pa was gradually increased, and the number of times of repetitive striking was measured.

[Second Experiment]

As shown in FIG. 3A, a position Pb was made at a location on the big jack portion 10*a*, away from the rotational shaft by the distance L.

In the second experiment, a plummet Mb was attached to the position Pb and the same measurements as in the first experiment were recorded.

[Results of Experiments]

FIG. 3B shows the results of the experiments. The vertical axis shows the number of times of repetitive striking. The horizontal axis shows the weight of load (the weight of the plummets Ma, Mb). The results of the first experiment are indicated by a single-dashed line and the results of the second experiment are indicated by a double-dashed line.

As seen in the results, the first experiment (that is, applying weight to the small jack portion 10*b*) shows a larger decrease in the repeated striking property with addition of weight as compared to the second experiment (that is, applying weight to the big jack portion 10*a*). Therefore, the effects produced on repetitive striking performance appear to be larger in the first experiment.

From the experiments above, it was found that in order to improve the repetitive striking performance, a reduction in weight of the small jack portion 10*b* of the jack 10 is more effective than a similar reduction in weight of the big jack portion 10*a*.

In the above description, an embodiment of the present invention has been detailed. However, the present invention is not limited to the above embodiment, and other modifications and variations may be possible.

Figure 4C:
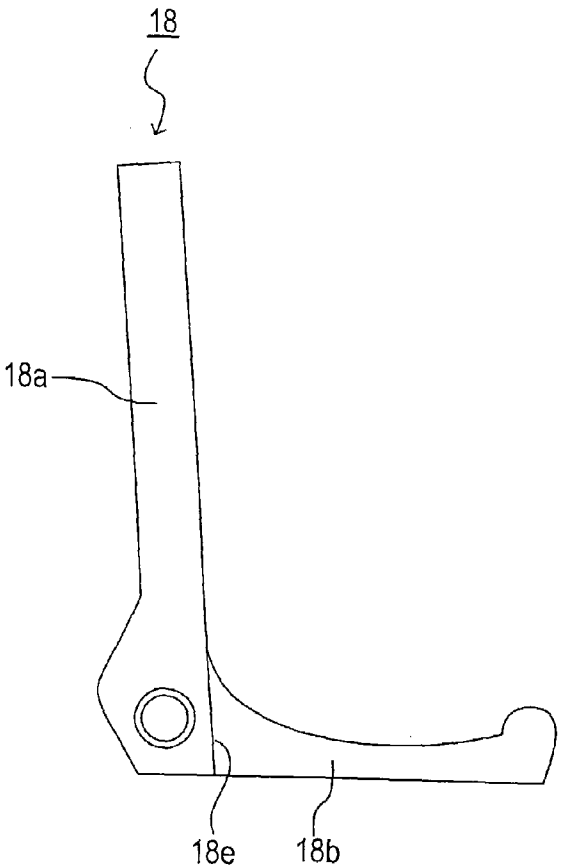
FIGS. 4A–4C are views illustrating variations of a lightened small jack portion.
Figure 4B:
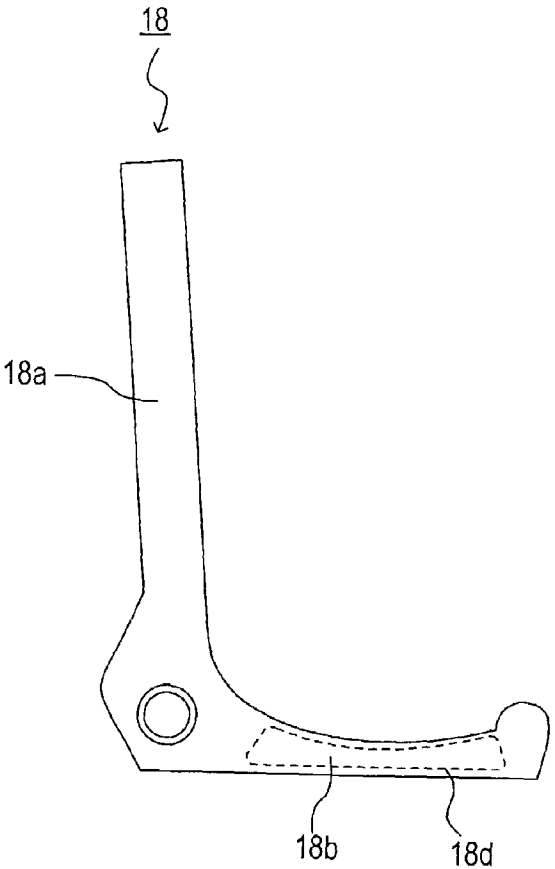
Figure 4A:
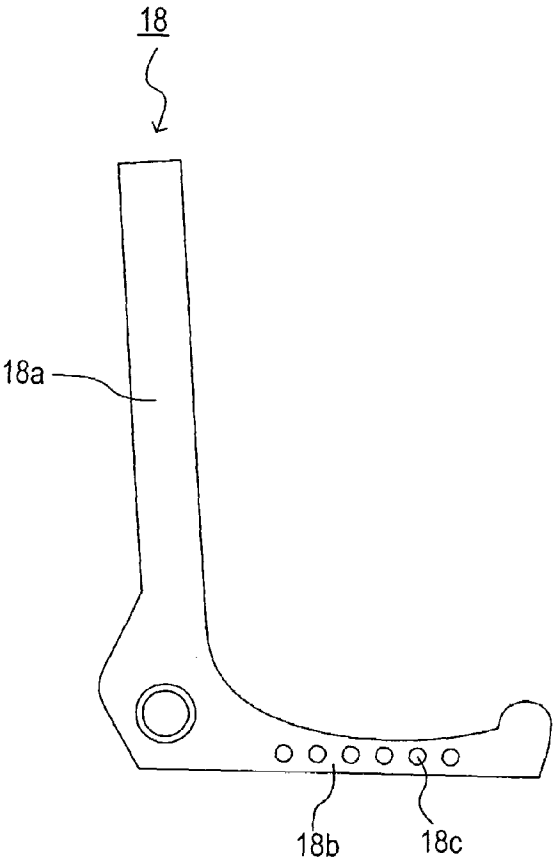

For instance, the shape of the jack 18 is not limited to the shape shown in FIG. 2A. The outer periphery of the lightened small jack portion 18*b* may be ground to reduce the weight or directly formed in the desired shape. Furthermore, the weight reduction may not be necessarily executed by changing the shape of the lightened small jack portion 18*b*. As shown in FIGS. 4A–4C, the lightened small jack portion 18*b* may be hollowed, contain holes 18*c*, cavities 18*d*, or voids, or use a material or combination of materials that is lighter than that of the big jack portion 18*a*. A line 18*e* in FIG. 4C is a boundary line between the big jack portion 18*a* and the lightened small jack portion 18*b*. The lightened small jack portion 18*b* may also be formed from a material with a higher strength to weight ratio than the material used in the big jack portion 18*a*. While polyacetal (specific gravity: 1.3) is used for the material of the big jack portion 18*a*, ABS resin (specific gravity: 1.1), for example, may be used for the small jack portion 18*b*. Other than ABS resin, polypropyrene (specific gravity: 0.9–1.0) or wood (specific gravity: 0.3–0.6) may be used for the small jack portion 18*b*. The aforementioned lightening techniques can be adapted to the small jack portion of an upright piano as well.

What is claimed is:

1. A method of improving repetitive striking performance of a piano comprising an action mechanism in which a substantially L-shaped jack pushes up a part of a striking member in response to key depression in order to cause the striking member to strike a string, the jack being composed of elongated portions comprising:

a big jack portion for pushing up the striking member, and a small jack portion integrated almost perpendicular to the big jack portion, wherein the small jack portion is lightened by at least one of the following steps:

forming the lightened small jack portion from a material with a higher strength versus weight ratio than a material from which the big jack portion is manufactured, incorporating voids into the small jack portion, providing the small jack portion with a thickness less than that of the big jack portion, manufacturing the small jack portion from a material less dense than a material from which the big jack portion is manufactured, and curving an upper side of the small jack portion into a concave shape.

2. A jack for use in an action mechanism of a piano, that is formed into substantially an L-shape and pushes up a part of a striking member in response to key depression in order to cause the striking member to strike a string, the jack being composed of:

an elongated big jack portion for pushing up the part of the striking member, and a lightened small jack portion integrated almost perpendicular to the big jack portion, wherein a weight of the lightened small jack portion is decreased by at least one of:

the lightened small jack portion has a curved concave upper side, the lightened small jack portion is thinner than the big jack portion, the lightened small jack portion is manufactured from a material less dense than a material from which the big jack portion is manufactured, the lightened small jack portion is formed from a material with a higher strength versus weight ratio than a material from which the big jack portion is manufactured, and the lightened small jack portion contains voids therein.

3. An action mechanism of a piano, comprising a substantially L-shaped jack that pushes up a part of a striking member in response to key depression in order to cause the striking member to strike a string, the jack being composed of:

an elongated big jack portion for pushing up the part of the striking member, and a lightened small jack portion integrated almost perpendicular to the big jack portion wherein a weight of the lightened small jack portion is decreased by at least one of:

the lightened small jack portion has a curved concave upper side, the lightened small jack portion is thinner than the big jack portion, the lightened small jack portion is manufactured from a material less dense than a material from which the big jack portion is manufactured, the lightened small jack portion is formed from a material with a higher strength versus weight ratio than a material from which the big jack portion is manufactured, and the lightened small jack portion contains voids therein.

* * * * *